US011745200B2

(12) United States Patent
Goettke et al.

(10) Patent No.: US 11,745,200 B2
(45) Date of Patent: Sep. 5, 2023

(54) DISPENSER FOR DISPENSING FLOWABLE MASSES

(71) Applicant: RPC Bramlage GmbH, Lohne (DE)

(72) Inventors: Sabine Goettke, Lohne (DE); Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 160 days.

(21) Appl. No.: 17/435,760

(22) PCT Filed: Mar. 2, 2020

(86) PCT No.: PCT/EP2020/055406

§ 371 (c)(1),
(2) Date: Sep. 2, 2021

(87) PCT Pub. No.: WO2020/178225

PCT Pub. Date: Sep. 10, 2020

(65) Prior Publication Data

US 2022/0152640 A1 May 19, 2022

(30) Foreign Application Priority Data

Mar. 5, 2019 (DE) ..... 10 2019 105 568.7

(51) Int. Cl.
*B05B 11/00* (2023.01)
*B05B 11/10* (2023.01)
*B05B 11/02* (2023.01)

(52) U.S. Cl.
CPC ..... *B05B 11/1047* (2023.01); *B05B 11/0013* (2013.01); *B05B 11/028* (2023.01); *B05B 11/1069* (2023.01); *B05B 11/1074* (2023.01)

(58) Field of Classification Search
CPC ..... B05B 11/1047; B05B 11/1069; B05B 11/1074; B05B 11/028; B05B 11/0013;
(Continued)

(56) References Cited

U.S. PATENT DOCUMENTS 5,104,004 A 4/1992 Von Schuckmann
5,289,952 A * 3/1994 Gueret ..... B05B 11/00446 222/401

(Continued)

FOREIGN PATENT DOCUMENTS

DE 39 00 267 A1 7/1990
DE 199 38 798 A1 3/2001

(Continued)

OTHER PUBLICATIONS

International Search Report of PCT/EP2020/055406, dated Oct. 22, 2020.

*Primary Examiner* — Lien M Ngo
(74) *Attorney, Agent, or Firm* — Collard & Roe, P.C.

(57) ABSTRACT

A dispenser for dispensing flowable masses has a reservoir and a modular dispenser pump with an input channel, an output channel and a pump chamber. A head piece is provided and has a dispensing opening and a dispensing channel. The dispenser pump can be inserted into the reservoir and can be connected to the reservoir by a locking connection. The pump chamber is formed by a piston and a cup part. The piston is slidably accommodated in the cup part. The cup part has fastening formations for fastening interaction with an inner wall of the reservoir. The locking connection is provided by two radially outwardly protruding locking beads, which are spaced apart from one another in the vertical direction. The locking beads are designed with an insertion rounding on the reservoir side and with a substantially horizontal contact surface with respect to the longitudinal section on the head piece side.

14 Claims, 2 Drawing Sheets

(58) Field of Classification Search
CPC ..... B05B 11/1064; B05B 11/1041; B05B 11/007; B05B 11/1001; B05B 11/1042
See application file for complete search history.

(56) References Cited

U.S. PATENT DOCUMENTS

| | | | | |
|---|---|---|---|---|
| 6,240,979 | B1 * | 6/2001 | Lorscheidt | B05B 11/1061 141/2 |
| 6,371,333 | B2 | 4/2002 | Lorscheidt et al. | |
| 6,705,493 | B1 | 3/2004 | Mijers | |
| 8,556,130 | B2 * | 10/2013 | Law | B05B 11/1047 222/256 |
| 9,205,439 | B2 | 12/2015 | Goettke et al. | |
| 2001/0025863 | A1 * | 10/2001 | Lorscheidt | B05B 11/026 222/321.9 |
| 2003/0168477 | A1 * | 9/2003 | Heukamp | B05B 11/1001 222/321.9 |
| 2007/0272712 | A1 * | 11/2007 | Pardonge | B05B 11/1074 222/321.6 |
| 2013/0008924 | A1 * | 1/2013 | Lafosse | B65D 83/0033 222/386 |

FOREIGN PATENT DOCUMENTS

| | | | |
|---|---|---|---|
| DE | 103 30 040 | A1 | 1/2005 |
| DE | 10 2008 030 118 | A1 | 1/2009 |
| DE | 10 2011 001 512 | A1 | 9/2012 |
| EP | 1 015 340 | B1 | 5/2003 |

* cited by examiner

DISPENSER FOR DISPENSING FLOWABLE MASSES

CROSS REFERENCE TO RELATED APPLICATIONS

This application is the National Stage of PCT/EP2020/055406 filed on Mar. 2, 2020, which claims priority under 35 U.S.C. § 119 of German Application No. 10 2019 105 568.7 filed on Mar. 5, 2019, the disclosures of which are incorporated by reference. The international application under PCT article 21 (2) was not published in English.

TECHNICAL FIELD

The invention pertains to a dispenser for dispensing flowable masses such as liquid or pasty masses, comprising a reservoir for accommodating the mass and a modular dispenser pump, wherein the dispenser has a longitudinal axis, wherein the dispenser pump furthermore has an input channel and an output channel and a pump chamber, which is delimited by valves on the input side and the output side, as well as a head piece, wherein the head piece has a dispensing opening and a dispensing channel, wherein the dispenser pump furthermore can be inserted into the reservoir and in the process connected to the reservoir by means of a locking connection, wherein the pump chamber furthermore is formed by a piston and a cup part, which has a cup bottom and a cup wall, wherein the piston is accommodated in the cup part in a slidable manner in order to achieve a pump stroke, wherein the cup part furthermore has on its outer wall fastening formations for fastening interaction with an inner wall of the reservoir, and wherein the locking connection is reinforced in that the locking connection is with respect to a longitudinal cross section through the dispenser formed by two locking beads that are spaced apart from one another in the vertical direction and protrude radially outward.

PRIOR ART

A dispenser with a modular and exchangeable design of the dispenser pump is known, for example, from EP 1 015 340 B1. This design results in a compact dispenser pump, which can be used in a plurality of dispensers that can be designed freely with respect to their head piece and storage container.

DE 10 2008 030 118 A1 discloses a dispenser with a locking connection, wherein the locking connection is specifically produced by means of a locking bead. However, this locking connection is not considered to be satisfactory in every respect.

DE 103 30 040 A1 discloses a dispenser, in which the pump chamber has a cup part that is connected to an inner wall of the reservoir. In the course of a pumping process, the mass is pressed into an output channel and simultaneously presses back a valve that closes a dispensing opening of the output channel in an elastically yielding manner, wherein a free space is assigned to the valve on the side facing away from the mass. In order to prevent an overpressure in the free space, an air path is provided from the free space into the interior formed by the cup part and the piston part, wherein said interior in turn has an air path toward the outside. The piston part is directly guided on a wall part that also forms an outer surface of the cup part.

SUMMARY OF THE INVENTION

In light of the above-described prior art, the invention is based on the objective of designing a dispenser of the type in question advantageously with respect to a fastening arrangement.

According to a first inventive idea, this objective is potentially attained with a dispenser, in which it is proposed that both locking beads are realized with an insertion rounding on the reservoir side and, in contrast, with an essentially horizontal contact surface with respect to a longitudinal cross section on the head piece side.

The proposed design results in a dispenser with particularly high functional reliability. The dispenser pump can be readily combined with a plurality of different reservoirs in the course of a manufacturing assembly. However, an operationally reliable and practically inseparable connection is produced once a combination has been assembled and the dispenser pump is locked in the reservoir.

With respect to the manufacture of the dispenser and an initial connection between the dispenser pump and the reservoir, it is furthermore ensured that the dispenser pump can be connected to any reservoir, the design of which is adapted with respect to the connection, namely with a comparatively simple design of the connecting formations on the dispenser pump and the reservoir. Consequently, the manufacturer furthermore has great freedom in selecting between different dispenser pumps or different reservoirs prior to the actual assembly of the dispenser pump and the reservoir.

The reinforced locking connection between the dispenser pump and the reservoir is on the other hand secured by the two locking beads, which are spaced apart from one another in the vertical direction, protrude radially outward and respectively have an insertion rounding on the reservoir side and a horizontally extending contact surface on the head piece side. Once the connection has been produced, the dispenser pump is reliably held on the reservoir, namely also under an increased load, particularly an increased external load. For example, a lateral load exerted upon the locking connection with respect to the longitudinal axis of the dispenser (and accordingly from radially outside) therefore also cannot trigger an effect that disengages the locking connection. As a result of the reinforced locking connection, the dispenser pump cannot be separated from the reservoir, particularly not by means of a normal manual force, even if the dispenser pump is potentially used in a dispenser that is arranged, for example, in a massage head.

As a result of this design, it can furthermore be ensured that the dispenser pump cannot be separated from the associated reservoir and assigned to another, improper reservoir without extraordinary effort.

Furthermore, the reinforcement preferably is chosen in such a way that a force required for disengaging the locking connection is at least 1.5-times greater and up to 3-times or 5-times greater than the force required for disengaging the known locking connection, particularly the locking connection known from the aforementioned prior art.

The locking connection preferably is realized in such a way that it cannot be disengaged by means of a normal manual force, i.e. without tools and in a nondestructive manner.

Other characteristics of the invention are frequently described below, as well as in the description of the figures, in their preferred association with the object of claim 1 or with characteristics of other claims. However, they may also be important in association with only individual characteristics of claim 1 or the respective other claim or independently.

The locking beads may with respect to the longitudinal axis extend annularly and accordingly over the entire circumference of the respective part of the dispenser pump or the reservoir comprising the locking bead. In this case, the mating locking part, i.e. the reservoir or the dispenser pump, preferably has locking grooves that are designed accordingly and cross-sectionally adapted. These locking grooves preferably can also extend over the entire circumference.

Alternatively, the locking beads and optionally also the locking grooves may only extend over a partial section of the circumference, wherein a plurality of locking beads and locking grooves may optionally be provided over the circumference.

The spacing between the locking beads in an axial direction preferably corresponds to 1-times to 5-times, particularly 1.5-times to 2-times, the dimension of a locking bead viewed in the same direction.

The two locking beads may have identical cross sections, namely with respect to their geometric design and also with respect to their axial and radial dimensions. Furthermore, the cross sections of the locking beads may also be realized differently, namely likewise with respect to their geometric design and/or their radial and/or axial dimensions.

The insertion rounding, which is respectively provided on the locking beads on the reservoir side, acts in an assistive manner in the course of fastening the dispenser pump on the reservoir. As a result of the insertion rounding, an outer edge surrounding the reservoir opening, as well as the locking groove initially formed in the inserting direction, is advantageously overrun.

The contact surface provided on both locking beads on the head piece side, which referred to the longitudinal cross section essentially extends horizontally, interacts with a mating contact surface of the locking grooves in the interlocked fixing position of the dispenser pump on the reservoir, wherein said mating contact surface preferably extends in the same direction and therefore also essentially horizontally.

As a result of this design, the locking beads are shaped in a barb-like manner such that an insertion and movement of the dispenser pump into the interlocked position with the reservoir is simplified, but the disengagement of the interlock is prevented.

The invention furthermore pertains to a dispenser for dispensing flowable masses such as liquid or pasty masses, comprising a reservoir for accommodating the mass and a modular dispenser pump, wherein the dispenser has a longitudinal axis, wherein the dispenser pump furthermore has an input channel and an output channel and a pump chamber, which is delimited by valves on the input side and the output side, as well as a head piece, wherein the head piece has a dispensing opening and a dispensing channel, wherein the pump chamber furthermore is formed by a piston and a cup part, which has a cup bottom and a cup wall, wherein the piston is accommodated in the cup part in a slidable manner in order to achieve a pump stroke and a return spring acts between a piston part connected to the piston and the cup bottom, wherein the piston part furthermore has a contact ceiling, on which the return spring supported on the cup bottom abuts and which forms a first interior space together with the cup part, wherein the volume of said first interior space changes during a pump actuation, and wherein the first interior space furthermore is surrounded by a second interior space that is formed between the head piece, the cup part and the piston part.

In a dispenser known from DE 10330040 A1, a first interior space is connected to a second interior space lying on top of the first interior space. During a depression, however, the volume in the first and the second interior space is merely compressed, wherein the second interior space is additionally reduced in size by a closure part when the dispenser is opened and the pressure is also increased in the first interior space.

In a dispenser known from DE 19938798 A1, only two interior spaces are likewise provided in a serial arrangement, but said interior spaces are not connected by a ventilation opening. This also applies to the dispensers known from DE 3900267 A1 and EP 1015340 B1. Based on a dispenser of the type known, for example, from DE 10 2008 030 118 A1, the invention aims to ensure advantageous handling.

This objective is attained with the object of claim 9, wherein it is proposed that an air path is formed in the contact ceiling in order to prevent a pressure buildup in the first interior space in the course of a pump actuation.

The proposed air path makes it possible to prevent the potential formation of an air cushion between the cup part and the piston part during an actuation of the dispenser pump, particularly during a reduction of the pump chamber volume. An associated pressure buildup would lead to an additional increase of the actuating force required for displacing the head piece beyond the restoring force of the resetting device. This problem is avoided by the proposed air path. In the preferred embodiment, the interior space being formed between the cup part and the piston part is subjected to the ambient air pressure via the air path regardless of the position of the head piece relative to the dispenser pump.

The second interior space surrounding the first interior space is connected to the ambient air by a normally formed gap between the head piece and the cup part and therefore under the same pressure. Air flowing from the first interior space into the second interior space during an actuation in order to prevent an overpressure in the first interior space therefore can readily escape into the surroundings without causing a relevant pressure buildup in the second interior space.

In a potential embodiment, the air path may be formed in a bore of sorts in the upper end wall of the piston part. The end wall may also be almost completely opened outside the constructively required regions for holding, for example, a partial piston wall and a connection to the output channel such that a correspondingly enlarged air path is formed. Furthermore, the end wall of the piston part may be realized in a spoke-like manner, e.g. with respect to a top view, in which the longitudinal axis is illustrated in the form of a point, wherein the air paths are formed between the spokes.

BRIEF DESCRIPTION OF THE DRAWINGS

The invention is described in greater detail below with reference to the attached drawings that merely show an exemplary embodiment. In these drawings.

DESCRIPTION OF THE EMBODIMENTS

Figure 1:
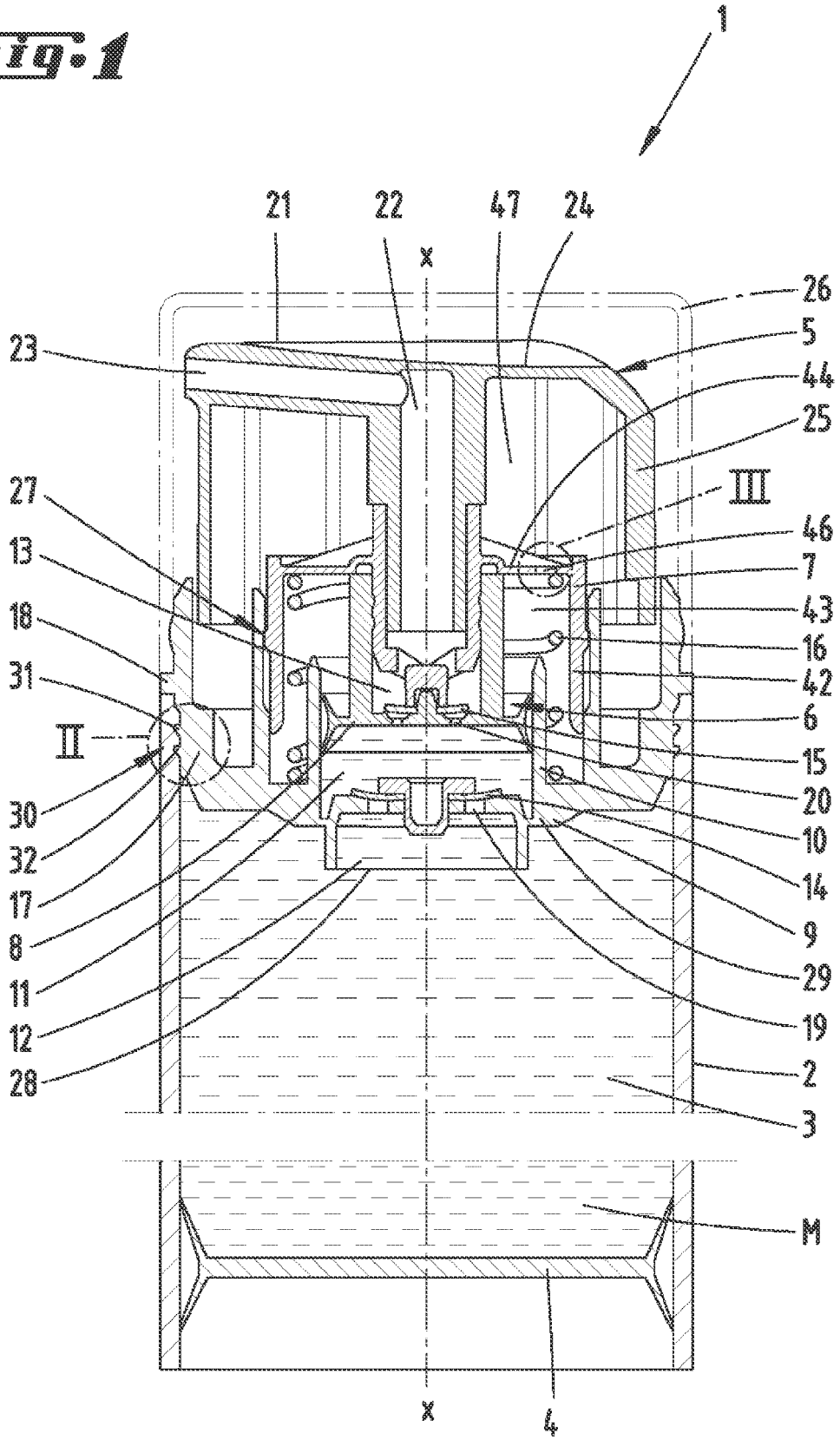
FIG. 1 shows a dispenser of the type in question in the form of a longitudinal section.

A dispenser 1 for being arranged on a reservoir 2 is initially described with reference to FIG. 1.

In the exemplary embodiment shown, the reservoir 2 is realized in the form of an essentially cylindrical body with a central longitudinal axis x, which in the correspondingly associated position also extends through the dispenser 1, preferably in the form of a rotational axis.

The reservoir 2 has a storage chamber 3 for accommodating a mass M to be dispensed. This storage chamber 3 is on its bottom side delimited by a follower piston 4.

The dispenser 1 is inserted into the opening of the reservoir 2, which in a normal installation state of the reservoir 2 points upward, and connected to the reservoir 2.

The dispenser 1 essentially is composed of a head piece 5 and a dispenser pump 6.

The dispenser pump 6 initially has a piston body 7 with a piston 8 and a cup part 9 with a cup bottom 28 and a cylinder section 10. In this case, the piston 8 is accommodated in the cylinder section 10 so as to be slidable along the longitudinal axis x, wherein a pump chamber 11 is formed between the piston 8 and the cylinder section 10 and furthermore delimited by the cup bottom 28 of the cup part 9.

The cup part 9 is realized in an exchangeable manner in order to be adapted to different reservoirs 2, particularly to different opening diameters and/or opening cross sections of the reservoir 2.

The pump chamber 11 connects an input channel 12 and an output channel 13, wherein both channels can be respectively separated from the pump chamber 11 by a valve 14 on the input side and a valve 15 on the output side.

The two valves 14 and 15 are realized in the form of check valves and preferably installed in such a way that they open in the same direction, i.e. in the dispensing direction.

A resetting device 16, which in this case is realized in the form of a cylindrical spring, is arranged between the piston part 7 and the cylinder section 10. This spring may conventionally consist of a metallic cylindrical spring. Alternatively, a spring that is made of an elastically resilient plastic material may also be provided in order to realize an all-plastic dispenser.

The resetting device 16 furthermore is arranged such that it is on one end supported on the cup bottom 28 in preferably concentric arrangement to the longitudinal axis x and on the other end acts against an upper end wall of the piston part 7, namely in such a way that the head piece 5 with the piston part 7 and the piston 8 is acted upon in the direction of a pump chamber enlargement in order to once again fill the pump chamber 11 after carrying out a pumping stroke, during which the pump chamber volume is reduced.

The piston part 7 and the cup part 9 respectively are realized in an essentially cup-shaped manner. They are engaged with one another and jointly delimit the dispenser pump 6 outward such that a capsule-like housing is formed. At least one fastening projection 28, which may also be realized, for example, in the form of an annular projection, may be provided on a radial cup wall 17 of the cup part 9. This fastening projection 18 serves for fixing the position of the dispenser pump 6 in the installed state between the head piece 5 and the reservoir 2.

In the exemplary embodiment shown, the valves 14 and 15 are realized in the form of so-called annular gap valves with an annular valve body, which respectively covers a respective annular gap 19 or 20 of the respective input or output channel 12, 13.

A homogenous dispensing behavior is achieved due to the radially symmetrical design of the dispenser pump 6. However, the dispenser pump is not limited to radially symmetrical designs, but rather may also have an arbitrary cross-sectional shape, e.g. a square or polygonal shape. Other known check valves such as flap valves may also be used instead of the annular gap valves shown.

Furthermore, the piston may be realized integrally with the piston part 7. A kinematic reversion of the dispenser pump 6 with a reversal of the opening direction of the check valves is also possible.

The dispenser pump 3 is adjoined by the head piece 5 that has a dome-like actuating part 21 with a dispensing channel 22 and a dispensing opening 23, as well as an actuating surface 24, which preferably is formed on its upper side and directed transverse to the longitudinal axis x, and a partial actuating wall 25, which extends circumferentially and is optionally arranged concentric to the longitudinal axis x.

On its outer wall, the actuating part 21 preferably is guided in the axial direction circumferentially by the cup wall 17 of the cup part 9 with the aid of its partial actuating wall 25.

With respect to a cross-sectional view, in which the longitudinal axis x is illustrated in the form of a line such as in FIG. 1, the dispensing channel 22, which in the exemplary embodiment shown initially accommodates the longitudinal axis x along its longitudinal extent centrally, extends outward under inclusion of a preferably obtuse angle to the longitudinal axis x and leads into the dispensing opening 23. In this case, the dispensing channel 22 is inserted into the output channel 13 in a sealing manner, wherein the piston 8, the piston part 7 and the dispensing channel 22 including the actuating part 21 furthermore interact in the usage position in order to be jointly displaced along the longitudinal axis x. The entire head piece 5 with the piston 8 fixed thereon accordingly is supported by means of the resetting device 16.

When the dispenser pump 6 or the dispenser 1 as a whole is inserted into the reservoir 2, a lower edge 28 of the dispenser pump 6 penetrates with its input channel 12 into the reservoir 2 and therefore into the mass M stored therein to such a depth that direct contact with the mass M to be dispensed is produced. When the dispenser 1 is attached to the reservoir 2, the mass M therefore preferably can spread out as far as into the pump chamber 11 through the input valve 14, which in the course of the attachment opens as a result of pressure application, in order to initially fill said pump chamber.

FIG. 1 furthermore shows that the dispenser 1, particularly the head piece 5, may be covered by a cap 26 in the non-usage position. In this case, this cap is fixed in the region of the cup wall 17 in a locking manner, optionally and preferably while being axially supported on the fastening projection 18.

In addition, a limiting device 27 is provided for limiting the axial displaceability of the head piece 5 including the piston 8, particularly into a distant position referred to the cup part 9. The limiting position shown is the maximum filling position of the pump chamber 11.

The dispenser pump 6 is fixed on the reservoir 2 by means of a locking connection. 30. This locking connection is formed in a region that essentially lies directly underneath the fastening projection 18 of the cup part 9, which is supported on the wall of the reservoir 2.

Two locking beads 31, 32 are provided on the outer wall side of the cup wall 17, wherein said locking beads are spaced apart from one another with respect to the longitudinal axis x and respectively protrude radially outward beyond an otherwise circumferential outer surface 33 of the cup wall 17.

In a preferred embodiment, the outer surface 33 of this cup wall 17 abuts on the facing inner surface 34 of the chamber wall 35 in the secured locking position.

Figure 2:
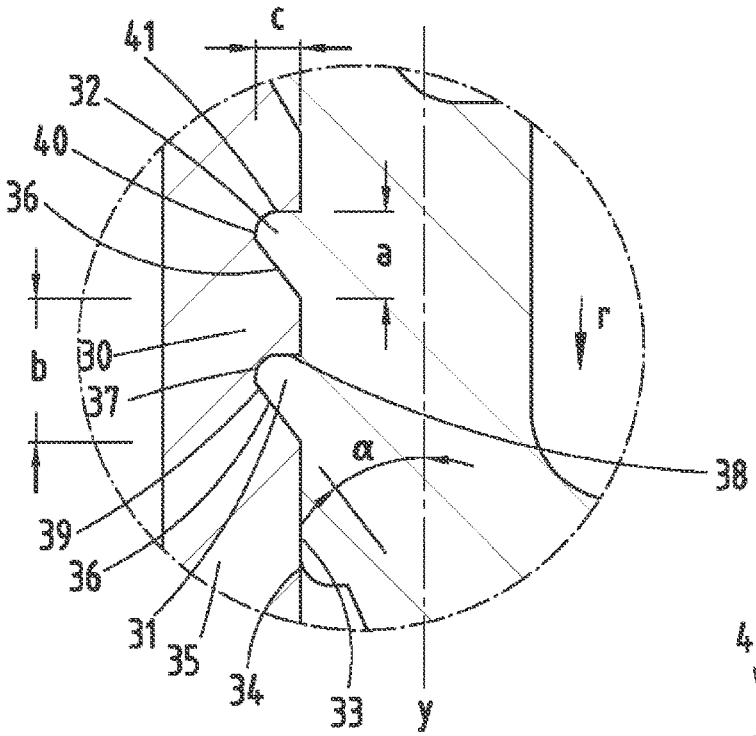
FIG. 2 shows an enlarged detail of the region II in FIG. 1.
Figure 3:
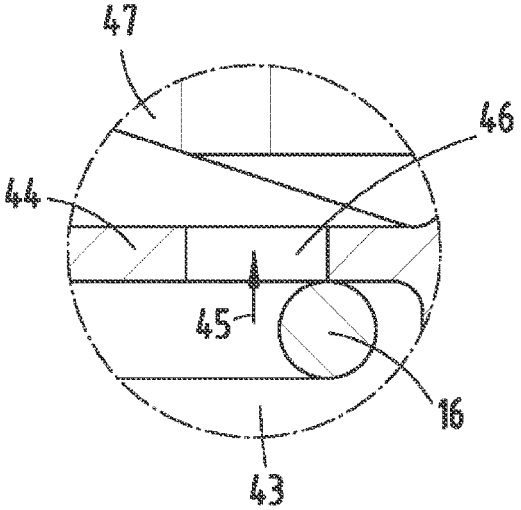
FIG. 3 shows an enlarged detail of the region III in FIG. 1.

In the exemplary embodiment shown, the two locking beads 31, 32 are realized identically with respect to a cross section according to FIG. 2.

Viewed in the inserting direction r of the dispenser pump 6 into the reservoir 2, each locking bead 31, 32 is initially provided with a limb 36 that includes an acute angle $\alpha$ of approximately 30 to 45 degrees with a line y extending axially parallel to the longitudinal axis x, wherein said limb extends radially outward in an ascending manner opposite to the inserting direction r.

This limb 36 transforms on its end into an insertion rounding 37, which in turn transforms into a contact surface 38 that in a longitudinal cross section extends approximately perpendicular to the longitudinal axis x. The contact surface 38 accordingly is directed opposite and transverse to the inserting direction r.

All in all, this results in an approximately triangular or wedge-shaped cross section of the locking beads 31, 32 with a corner design that is rounded due to the insertion rounding 37.

Viewed in the extending direction of the longitudinal axis x, a resulting height a of each locking bead 31, 32 may approximately correspond to ⅓ to ⅔, e.g. approximately ½, of the material thickness of the chamber wall 35. In this case, the height dimension a is measured between the root regions of the locking beads 31, 32, in which these locking beads transform into the outer surface 33 of the cup part 9 (compare to FIG. 2).

The spacing b between the locking beads 31, 32, which is likewise measured in the extending direction of the longitudinal axis x, may approximately correspond to 1.5-times to 3-times, furthermore approximately 2-times, the locking bead height a.

The radial extent c, which is measured transverse to the height a and in the locking position corresponds to the engagement dimension of the locking beads 31, 32 into the chamber wall 35, may approximately correspond to 0.3-times to 0.8-times, furthermore approximately 0.5-times, the bead height a.

In the locking position according to FIG. 2, the locking beads 31, 32 engage into correspondingly arranged and cross-sectionally adapted locking grooves 39 of the chamber wall 35. These locking grooves accordingly open toward the inner surface 34 of the chamber wall 35, wherein correspondingly oriented mating contact surfaces 41 are assigned to the contact surfaces 38 of the locking beads 31, 32 and cover the entire surface thereof in order to reinforce the locking position.

In the locking position, the locking beads 31, 32 lie in a rear engagement position with respect to the mating contact surfaces 41 of the locking grooves 39, 40.

The locking position can be advantageously located as a result of the insertion bevel-like design of the limbs 36 and the adjacent insertion rounding 37. Particularly the free upper outer edge of the chamber wall 35, as well as the locking groove 49 initially provided in the inserting direction r, is advantageously overrun. The limbs 36 and the insertion rounding 37 promote this effect.

A removal of the dispenser pump 6 from the locking position opposite to the inserting direction r is prevented due to the optionally full-surface contact of the contact surfaces 38 on the mating contact surfaces 41.

A first interior space 43 is formed between the cylinder section 10 of the cup part 9 and a partial piston wall 42 that comprises this cylinder section 10, as well as the resetting device 16. The resetting device 16, which preferably is realized in the form of a cylindrical spring, is accommodated in this first interior space.

The partial piston wall 42 is arranged on the piston part 7 by means of an upper contact ceiling 44, the underside of which is contacted by the resetting device 16.

The contact ceiling 44 has an air path 45 in order to prevent a pressure buildup in the interior space 43 in the course of an actuation of the head piece 5 and an associated reduction of the volume of the pump chamber 11 and also the volume of the interior space 43, wherein said air path connects the first interior space 43 to the surroundings by using a second interior space 47 that surrounds the first interior space. Accordingly, a normal ambient pressure in the first interior space 43 results in the first interior space 43 regardless of the position of the head piece 5 relative to the dispenser pump 6.

Figure 4:
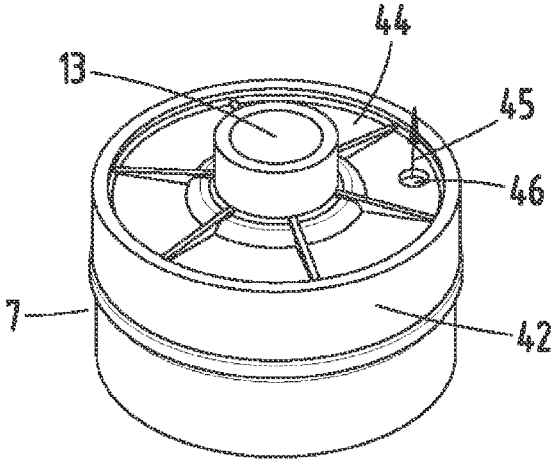
FIG. 4 shows an individual perspective view of a piston part of the dispenser.

The second interior space 47 evidently opens into a gap between the head piece 5 and the cover part 9, which allows a constant exchange with the ambient air. When the head piece 5 is depressed as a result of an actuation of the dispenser, the first interior space 43 is reduced in size and air can in the process flow into the second interior space 47 through the air path, specifically the opening 46, and from this second interior space into the surroundings through the aforementioned gap. As mentioned above, the air path 45 is in the exemplary embodiment shown realized in the form of a bore-like opening 46 within the end wall 44 (compare particularly to FIG. 4).

In addition, this opening 46 makes it possible to achieve an improved aeration and ventilation of the spring chamber formed thereunder.

Furthermore, the opening 46 makes it possible to perform a control, e.g. a visual control, as to whether the resetting device 16 required for the function of the dispenser 1 is inserted in the course of the assembly of the dispenser 1. This resetting device normally is visible through the opening 46.

The preceding explanations serve for elucidating all inventions that are included in this application and respectively enhance the prior art independently with at least the following combinations of characteristics, wherein two, multiple or all of these combinations of characteristics may also be combined with one another, namely:

A dispenser 1, which is characterized in that the locking connection 30 is realized in a reinforced manner and/or that a pressure buildup with respect to an interior space formed by the cup part 9 and the piston part 7 is prevented by means of a suitable air path 45.

A dispenser 1, which is characterized in that the locking connection 30 is with respect to a longitudinal cross section through the dispenser 1 formed by two locking beads 31, 32, which are spaced apart from one another in the vertical direction and protrude radially outward.

A dispenser 1, which is characterized in that a locking bead 31, 32 or both locking beads 31, 32 are realized with an insertion rounding 37 on the reservoir side and, in contrast, with an essentially horizontal contact surface 38 with respect to a longitudinal cross section on the head piece side.

A dispenser 1, which is characterized in that the air path 45 is with respect to a longitudinal cross section formed by an opening 46 in an upper end wall 44 of the piston part 7.

All disclosed characteristics are essential to the invention (individually, but also in combination with one another). The disclosure of the associated/attached priority documents (copy of the priority application) is hereby fully incorporated into the disclosure content of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

LIST OF REFERENCE SYMBOLS

1 Dispenser
2 Reservoir
3 Storage chamber
4 Follower piston
5 Head piece
6 Dispenser pump
7 Piston part
8 Piston
9 Cup part
10 Cylinder section
11 Pump chamber
12 Input channel
13 Output channel
14 Valve on input side
15 Valve an output side
16 Resetting device
17 Cup wall
18 Fastening projection
19 Annular gap
20 Annular gap
21 Actuating part
22 Dispensing channel
23 Dispensing opening
24 Actuating surface
25 Partial actuating wall
26 Cap
27 Limiting device
28 Edge
29 Cup bottom
30 Locking connection
31 Locking bead
32 Locking bead
33 Outer surface
34 Inner surface
35 Chamber wall
36 Limb
37 Insertion rounding
38 Contact surface
39 Locking groove
40 Locking groove
41 Mating contact surface
42 Partial piston wall
43 Interior space
44 End wall
45 Air path
46 Opening
47 Second interior space
a Height
b Spacing
c Radial extent
r Inserting direction
x Longitudinal axis
y Axially parallel line
M Mass
α Angle

The invention claimed is:

1. A dispenser (1) for dispensing flowable masses (M) such as liquid or pasty masses, comprising: a reservoir (2) for accommodating the mass (M) and a modular dispenser pump (6), wherein the dispenser (1) has a longitudinal axis (x), wherein the dispenser pump (6) furthermore has an input channel and an output channel (12, 13) and a pump chamber (11), which is delimited by valves (14, 15) on an input side and an output side, as well as a head piece (5), wherein the head piece (5) has a dispensing opening (23) and a dispensing channel (22), wherein the dispenser pump (6) is configured to be inserted into the reservoir (2) and connected to the reservoir (2) by means of a locking connection, wherein the pump chamber (11) is formed by a piston (8) and a cup part (9), which has a cup bottom (29) and a cup wall (17), wherein the piston (8) is accommodated in the cup part (9) in a slidable manner in order to achieve a pump stroke (b), wherein the cup part (9) has on its outer wall fastening formations for fastening interaction with an inner wall of a chamber wall (35) of the reservoir (2), and wherein the locking connection (30) is reinforced in that the locking connection (30) is with respect to a longitudinal cross section through the dispenser (1) formed by two locking beads (31, 32) that are spaced apart from one another in a vertical direction and protrude radially outward, wherein both locking beads (31, 32) are realized with an insertion rounding (37) on the reservoir side and, in contrast, with an essentially horizontal contact surface (38) with respect to a longitudinal cross section on a head piece side, wherein both of the locking beads (31, 32) are identical, each locking bead (31, 32) being formed by a limb forming an acute angle (a) of about 30 to 45 degrees with a line (y) extending axially parallel to a longitudinal axis (x) of the dispenser, in an inserting direction (r) of the dispensing pump (6) into the reservoir (2), said limb extending radially outward in an ascending direction opposite to the inserting direction (r), wherein an end of the limb (36) transforms into the insertion rounding (37), which in turn transforms into the contact surface (38), the contact surface (38) extending approximately perpendicular to the longitudinal axis (x) in a longitudinal cross section, the contact surface (38) being directed opposite and transverse to the inserting direction (r), and wherein when viewed in a direction of the longitudinal axis (x), a resulting height (a) of each locking bead (31, 32) corresponds to approximately ⅓ to ⅔ of a thickness of the chamber wall (35), wherein the height (a) is measured starting from root regions of the locking beads (31, 32) in which these locking beads transform into the outer surface (33) of the cup part (9).

2. The dispenser according to claim 1, wherein the cup part (9) is realized in an exchangeable manner in order to be adapted to different reservoirs (2).

3. The dispenser according to claim 1, wherein a resetting device is provided and arranged between the piston (8) and the cup part (9).

4. The dispenser according to claim 1, wherein limiting devices (27) are provided for limiting a resetting movement, wherein said limiting devices (27) come in contact with one another at a maximum pump chamber volume.

5. The dispenser according to claim 1, wherein the dispensing channel (22) is configured to be inserted into the output channel (13) of the dispenser pump (6), wherein an insertion depth of the dispenser pump (6) into the reservoir (2) is so large that a lower edge (43) of the dispenser pump (6) with its input channel (12) is in direct contact with the mass (M) to be dispensed.

6. The dispenser according to claim 1, wherein the piston (8) interacts with a piston part (7) in order to be jointly displaced, and wherein the resetting device (16) acts between the piston part (7) and the cup part (9).

7. The dispenser according to claim 1, wherein a pressure buildup with respect to an interior space formed by the cup part (9) and the piston part (7) is prevented by means of a suitable air path (45).

8. The dispenser according to claim 7, wherein the air path (45) is with respect to a longitudinal cross section formed by an opening (46) in an upper end wall (44) of the piston part (7).

9. A dispenser (1) for dispensing flowable masses (M) such as liquid or pasty masses, comprising a reservoir (2) for accommodating the mass (M), and a dispenser pump (6), wherein the dispenser (1) has a longitudinal axis (x), wherein the dispenser pump (6) furthermore has an input channel and an output channel (12, 13) and a pump chamber (11), which is delimited by valves (14, 15) on the input side and the output side, as well as a head piece (5), wherein the head piece (5) has a dispensing opening (23) and a dispensing channel (22), wherein the pump chamber (11) furthermore is formed by a piston (8) and a cup part (9), which has a cup bottom (29 44) and a cup wall (17), wherein the piston (8) is accommodated in the cup part (9) in a slidable manner in order to achieve a pump stroke (b) and a return spring (16) acts between a piston part (7) connected to the piston (8) and the cup bottom (29, 44), wherein the piston part (7) has a contact ceiling, on which the return spring (16) supported on the cup bottom (29, 44) abuts and which forms a first interior space together with the cup part (9), wherein the volume of said first interior space changes during a pump actuation, and wherein the first interior space (43) furthermore is surrounded by a second interior space (47) that is formed between the head piece (5) and the cup part (9), as well as the piston part (7), wherein an air path (45) is formed in the contact ceiling in order to prevent a pressure buildup in the first interior space in the course of a pump actuation.

10. The dispenser according to claim 9, wherein the dispenser has a modular design.

11. The dispenser according to claim 9, wherein the dispenser pump (6) is configured to be inserted into the reservoir (2) and in the process connected to the reservoir (2) by means of a locking connection.

12. The dispenser according to claim 11, wherein the cup part (9) has on its outer wall fastening formations for fastening interaction with an inner wall of the reservoir (2).

13. The dispenser according to claim 12, wherein the locking connection is reinforced by means of locking beads, which with respect to a longitudinal section through the dispenser (2) are spaced apart from one another in a vertical direction and protrude radially outward.

14. The dispenser according to claim 13, wherein the locking beads (31, 32) are realized with an insertion rounding (37) on a reservoir side and, in contrast, with an essentially horizontal contact surface (38) with respect to a longitudinal cross section on a head piece side.

* * * * *